US006260625B1

(12) United States Patent
Phan et al.

(10) Patent No.: US 6,260,625 B1
(45) Date of Patent: Jul. 17, 2001

(54) APPARATUS AND METHOD FOR TORSIONAL AND LATERAL CENTRALIZING OF A RISER

(75) Inventors: Kim Phan, Houston; Gilbert Mican, Sealy; Jon Pelzl, New Braunfels; Jon VanBarneveld, Houston; Kent Harms, College Station, all of TX (US)

(73) Assignee: ABB Vetco Gray, Inc., Houston, TX (US)

( * ) Notice: Subject to any disclaimer, the term of this patent is extended or adjusted under 35 U.S.C. 154(b) by 0 days.

(21) Appl. No.: 09/336,929

(22) Filed: Jun. 21, 1999

(51) Int. Cl.[7] ..... E21B 33/035
(52) U.S. Cl. ..... 166/355; 166/350; 166/241.6
(58) Field of Search ..... 166/241.1, 241.6, 166/350, 355, 367; 405/224.2

(56) References Cited

U.S. PATENT DOCUMENTS

| | | | | |
|---|---|---|---|---|
| 4,053,022 | | 10/1977 | Mercier | 175/5 |
| 4,395,160 | * | 7/1983 | deJong | 405/195 |
| 4,469,181 | | 9/1984 | Kellett | 166/341 |
| 4,733,991 | | 3/1988 | Myers | 405/195 |
| 4,844,660 | | 7/1989 | Ortemond | 405/224 |
| 5,118,221 | * | 6/1992 | Copple | 405/224.2 |
| 5,169,265 | * | 12/1992 | Butler et al. | 405/224.4 |
| 5,479,990 | | 1/1996 | Peppel | 166/350 |
| 5,950,737 | * | 9/1999 | Chou et al. | 175/5 |

OTHER PUBLICATIONS

1242769(London) Aug. 11, 1971 "Improvements in or Relating to Offshore Drilling Apparatus".
GB2115858A (UK) Sep. 14, 1983 "Adjustable Conductor Guide Assembly for Subsea Wells and Methods and Tools for Adjustment Thereof".

* cited by examiner

*Primary Examiner*—David Bagnell
*Assistant Examiner*—J Dougherty
(74) *Attorney, Agent, or Firm*—James E. Bradley; Bracewell & Patterson, L.L.P.

(57) ABSTRACT

A centralizing device is provided for a riser of an offshore well platform having an opening through which the riser passes from the platform to a subsea wellhead. The riser has generally planar fins extending radially outward from its outer diameter. The centralizing device has a frame which is mounted to the platform about the riser. A plurality of centralizing rollers are mounted to the frame and are radially extensible relative to the riser. The centralizing rollers bear against the riser and retain it laterally. A plurality of torsional rollers are mounted to the frame and are extensible towards the fins. The torsional rollers bear against the fins and retain the riser torsionally.

20 Claims, 4 Drawing Sheets

APPARATUS AND METHOD FOR TORSIONAL AND LATERAL CENTRALIZING OF A RISER

TECHNICAL FIELD

This invention relates to offshore drilling and production platforms, and in particular to devices for guiding and positioning risers of such platforms.

BACKGROUND ART

In one type of offshore oil or gas well, a riser is connected between a subsea wellhead and a floating drilling and/or production platform. Oftentimes, the subsea wellhead is not in exact alignment with the platform that is used to secure the riser or handle the riser during assembly. Further, the platform may be subject to movement from wave action and the like, while the riser is stationarily held at the wellhead.

It is important that relative movement between the platform and the riser, due to wave action and the like, be constrained to facilitate production and drilling operations and maintain clearance between the riser and other platform equipment. Throughout drilling and production operations, various pieces of equipment must be attached and detached from the riser, and often the riser has work platforms joined thereto which extend outward from the riser. This leaves little clearance between the riser and its surroundings, thus movement of the platform relative to the riser may cause damage to the riser, the equipment and work platforms joined to the riser, and the surrounding platform and platform equipment. Further, relative riser movement complicates the alignment and coupling of equipment which must be attached and detached from the riser.

Centralizing devices of the prior art have maintained only the riser's lateral position relative to the platform. However, it is further desirable to also constrain torsional movement relative to the platform, because it allows more freedom in the design of attached equipment or work platforms. For example, a work platform joined to a riser may be rectangular and fit in a rectangular clearance bounded by platform equipment. Rotation of the platform relative to the riser may cause the work platform to contact and damage its surroundings.

SUMMARY OF THE INVENTION

The present invention is directed to a centralizing device which constrains lateral and torsional movement of a riser relative to the platform; the riser having fins extending outward from its outer diameter. The centralizing device has a frame for mounting to the platform. More than one centralizing roller is mounted to the frame. The centralizing rollers are adjustable radially relative to the riser to bear against the riser and limit its lateral movement relative to the platform. At least a pair of torsional rollers is also mounted to the frame. The torsional rollers are arranged in opposed to each other and are adjustable toward and away from each other. The torsional rollers are angularly and laterally adjustable about an axis of the frame. The torsional rollers may be mounted to a plate that allows translational movement relative to the frame. The plate may be mounted to a second plate that allows rotational movement relative to the frame. The centralizing rollers and the torsional rollers may be mounted on separate levels of the frame.

BEST MODE FOR CARRYING OUT THE INVENTION

Figure 1:
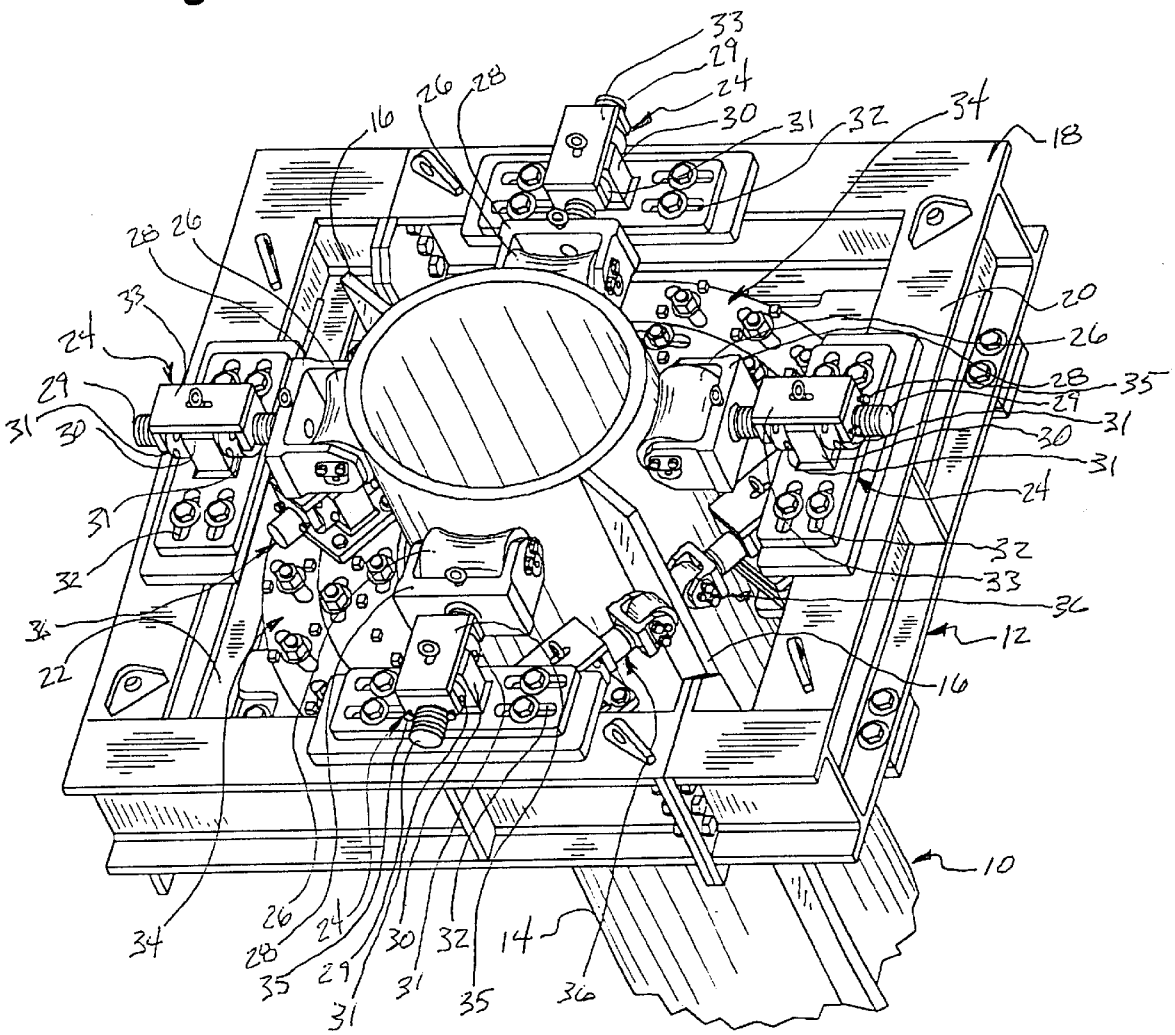
FIG. 1 is a perspective view of a riser centralizer constructed in accordance with this invention.
Figure 2:
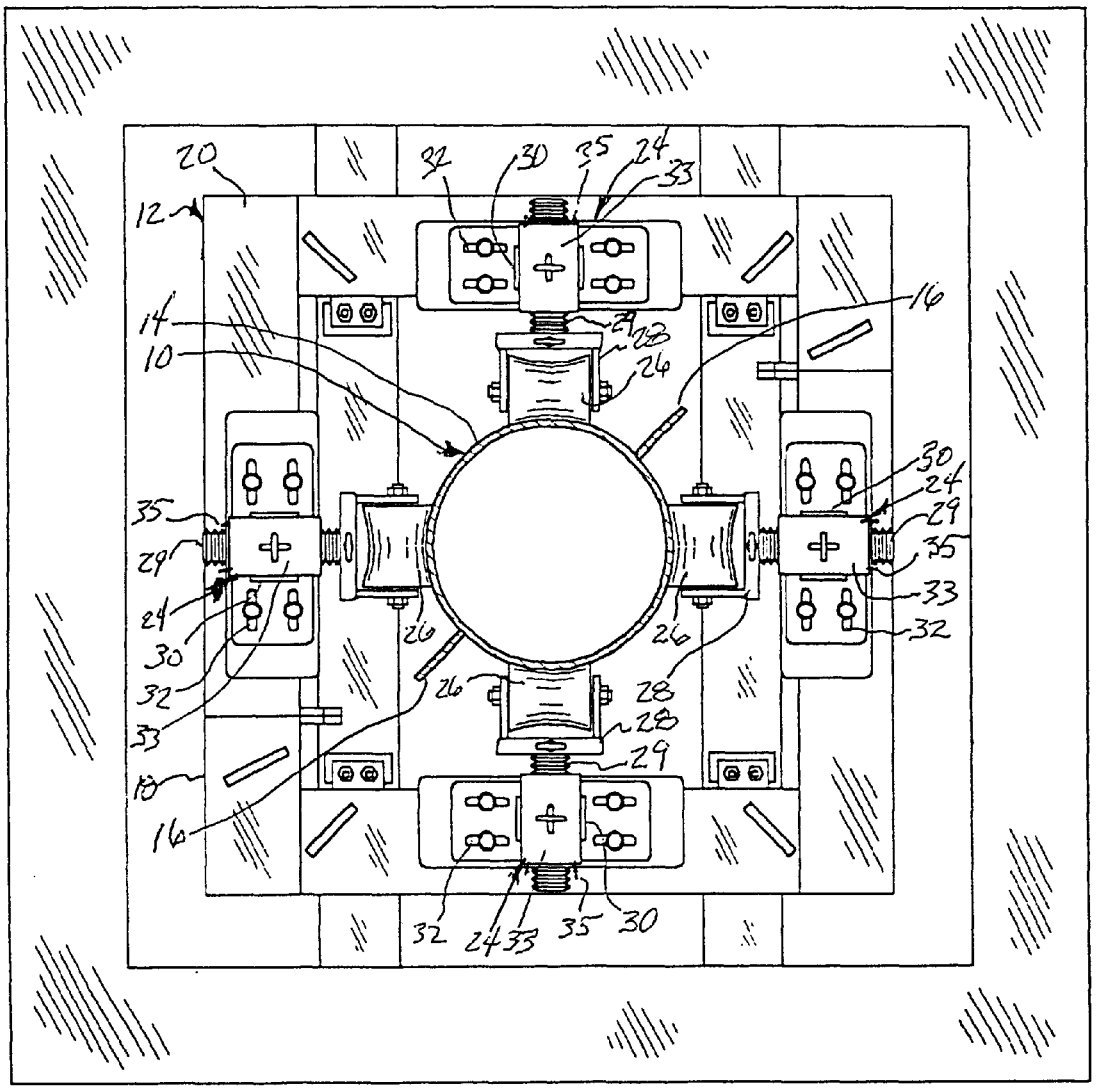
FIG. 2 is a top view of a riser centralizer constructed in accordance with this invention.
Figure 3:
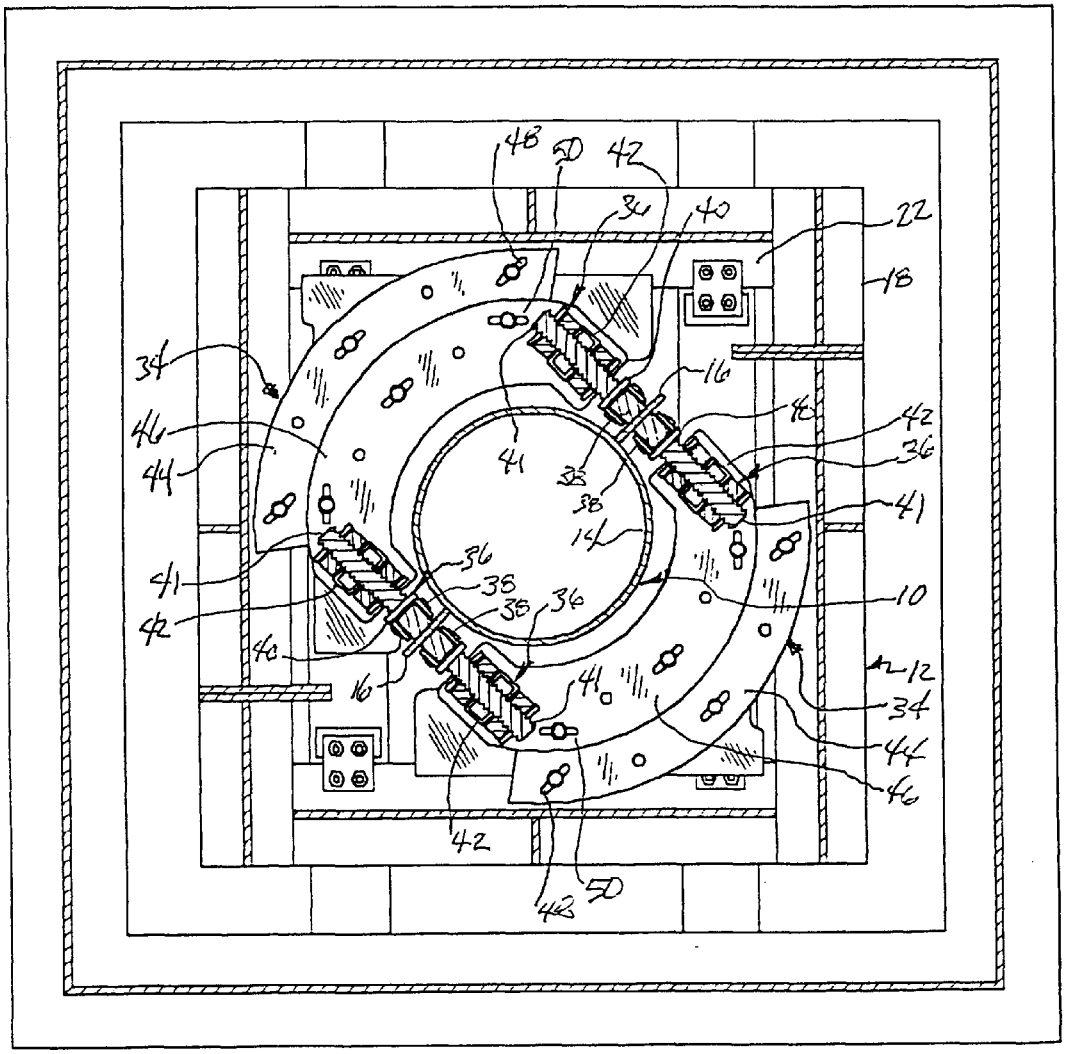
FIG. 3 is a sectional view of a riser centralizer constructed in accordance with this invention and taken along the line 3—3 of FIG. 4.
Figure 4:
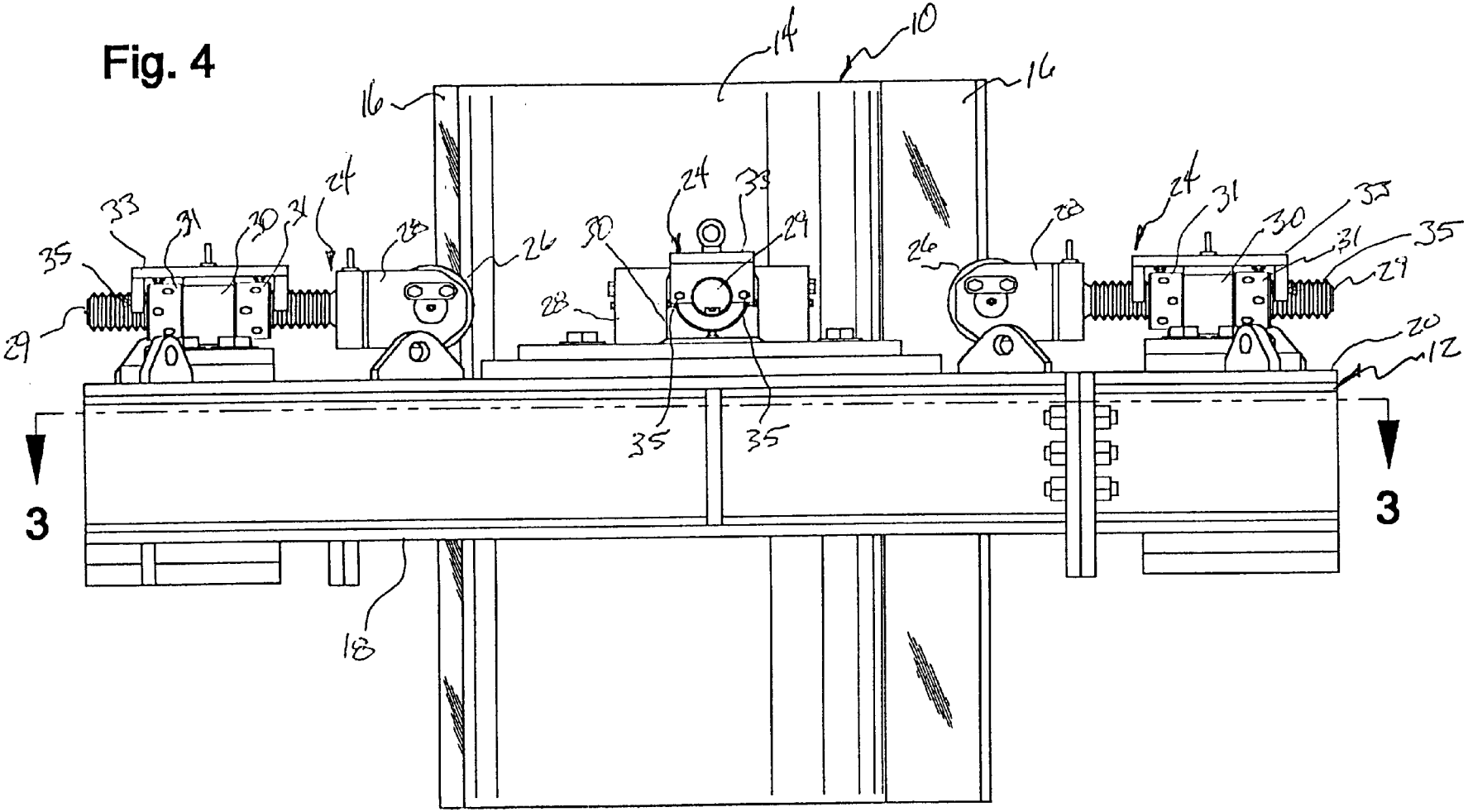
FIG. 4 is a side view of a riser centralizer constructed in accordance with this invention.

Referring first to FIG. 1, a riser 10 for use with a torsional and lateral riser centralizer 12 constructed in accordance with this invention generally comprises a series of elongate tubular pipe sections 14. Pipe sections 14 joined together to form a complete riser 10. The topmost section 14 has at least two generally planar fins 16. Fins 16 extend radially from the outer diameter of section 14 and run substantially the length of that section 14. In a preferred embodiment, there are two fins 16 spaced 180° apart, though more fins 16 spaced at a smaller interval is also within the scope of this invention.

Riser centralizer 12 has a deep section frame 18, preferably constructed from I-beams, which provides a planar upper surface or level 20 and an upwardly facing planar lower surface or level 22. A frame 18 defines an opening in the central portion of the frame 18. As viewed from above, frame 18 is square to facilitate mounting in a platform opening with the axis of frame 18 coinciding with the axis of the platform opening, but can be any shape required to fit the particular application. Preferably, frame 18 is split such that it can be separated and re-joined around the riser to facilitate installation.

A plurality of centralizing roller assemblies 24 are adjustably mounted to upper surface 20 and positioned to extend generally radially inward towards riser 10. In a preferred embodiment, there are four assemblies 24 mounted in 90° intervals. Each roller assembly 24 has a concave roller 26 whose outer profile is curved to mate with the outer diameter of riser 10. Roller 26 is mounted transversely in a roller carrier 28 in a manner which allows roller 26 rotate about a horizontal axis. Roller carrier 28 is joined to a threaded member 29 which extends outward from carrier 28 and slidably passes through roller base 30. Roller base 30 is a rectangular stub which is bolted through slots 32 for lateral adjustment to frame 18 and extends upward. Roller 26 is positioned radially with respect to riser 10 by capturing base 30 between two nuts 31 on threaded member 29. A preferred embodiment uses special nuts, known to those skilled in the art as tommy nuts, which are loosened or tightened by inserting a rod into a hole in the side of the nut rather than by using a conventional wrench. Roller 26 can be positioned radially inward toward riser 10 by loosening the inward nut 31 and tightening the outward nut 31. When the desired position is reached, the nuts 31 are tightened against base 30 and roller 26 is retained. Nuts 31 are secured with locking caps 33 placed over nuts 31 and base 30. Caps 33 have adjusting screws 35 which are tightened against nuts 31 to prevent loosening.

An adjustable mount 34, having two torsion roller assemblies 36 mounted thereto, is mounted in two opposed corners of lower surface 22. Each torsion roller assembly 36 generally has a cylindrical roller 38 mounted transversely in a roller carrier 40 to rotate about a horizontal axis. The horizontal axis is generally parallel to one of the fins 16 during use. Roller carrier 40 is joined to a threaded member 41 which slidingly passes through base 42. Roller assembly 36 is extensibly adjustable using nuts similar to nuts 31 of roller assembly 24. Locking caps 43 with adjusting screws 45 are similarly used to secure nuts 31. Loosening screws 45 allows rollers 38 of each pair to be moved closer and further from each other.

Base 42 is mounted to adjusting mount 34. Adjustable mount 34 has two generally C-shaped adjusting plates 44, 46; the first plate 44 having an inner diameter greater than the second plate 46, and second plate 46 having an inner diameter giving a clearance around the outer diameter of riser 10. A first adjusting plate 44 is bolted in a corner of frame 18 through a plurality of lateral adjusting slots 48 positioned to allow first plate 44 to move at an angle of approximately 45° to frame 18. In the embodiment shown, there are three slots 48 in each plate 44, slots 48 being parallel to each other. Second adjusting plate 46 is bolted to first plate 44 through a plurality of torsional adjusting slots 50 located near the outer circumference of second plate 46 and positioned to allow second plate 44 to rotate about an axis parallel or coinciding with the axis of riser 10. Each torsional adjusting slot 50 is normal to a radial line from the axis of frame opening. A torsion roller assembly 36 is mounted at each tip of C-shaped second plate 46 with the rotational axis of roller 38 aligned and spaced to contact fins 16.

In use, frame 18 of riser centralizer 12 is separated in preparation for installation. Riser 10 extends up from a subsea wellhead through an opening in the platform. Each half of frame 18 is secured to the platform about riser 10 then rejoined. Each centralizing roller assembly 24 is then adjusted laterally on frame 18 to align the curvature of roller 26 with the outer diameter of riser 10. Rollers 26 are then extended radially to bear against riser 10 by tightening inward nut 31 and loosening outward nut 31. When the desired radial position is reached, nuts 31 are tightened against base 30 and roller 26 is retained. Locking caps 33 are placed over nuts 31 and adjusting screws 35 are tightened against nuts 31 to further secure nuts 31. With all rollers 26 bearing against riser 10, lateral movement of the riser relative to the platform is constrained. Each second plate 46 is then adjusted about a vertical axis of the frame opening to align torsional rollers 38 to contact fins 16 on opposite sides. First plate 44 is adjusted laterally by loosening bolts and sliding along slots 50 to center riser 10 between roller assemblies 36. Rollers 38 are extended into contact with opposite sides of each of fins 16 with nuts 41 and secured by locking caps 31. With rollers 38 in contact with fins 16, torsional rotation of riser 10 relative to the platform is constrained.

The centralizing device of this invention has several advantages. As a whole, it is simple in design and relatively inexpensive to produce. The device has a frame formed in two sections and thus can be installed and removed with the riser in place. The centralizing rollers restrain the riser laterally yet allow relative vertical movement resulting from wave action. The torsional rollers additionally restrain relative rotation of the riser to the platform, thus allowing greater freedom in design of equipment and work platforms which are joined to the riser. The extensibility of both the centralizing rollers and torsional rollers uses a threaded member and nut. This mechanism is inexpensive to produce while still being robust.

While the invention has been shown in only one of its forms, it is not thus limited but is susceptible to various changes and modifications without departing from the spirit thereof.

We claim:

1. A device for centralizing a riser in a platform opening of an offshore platform, the riser having at least one fin extending outward from its outer diameter for movement with the riser, comprising:

a frame for mounting to said platform, said frame having a frame opening with an axis adapted to coincide with an axis of said platform opening;

a plurality of centralizing rollers carried on said frame and adjustable radially relative to said axis of said frame opening, for bearing against said riser and limiting said riser's lateral movement relative to said platform; and a pair of torsional rollers carried upon said frame, the torsional rollers being positioned for bearing against said at least one fin to reduce any relative rotation between said riser and said platform.

2. The device of claim 1 wherein said torsional rollers are opposed to each other and are adjustable toward and away from each other, to vary the spacing between said torsional rollers.

3. The device of claim 1 wherein said torsional rollers are angularly adjustable about said axis of said frame opening.

4. The device of claim 1 wherein said torsional rollers are laterally adjustable relative to said axis of said frame opening.

5. The device of claim 4 wherein each of said torsional rollers are rotatable about an axis generally parallel with a radial line of said axis of said frame opening.

6. The device of claim 1 wherein said frame has a first level and a second level, said centralizing rollers being carried on said first level and said torsional rollers being carried on said second level.

7. A device for centralizing a riser in a platform opening of an offshore platform, the riser having at least one fin extending outward from its outer diameter for movement with the riser, comprising:

a frame for mounting to said platform, said frame having a frame opening with an axis adapted to coincide with an axis of said platform opening;

a plurality of centralizing rollers carried on said frame and adjustable radially relative to said axis of said frame opening, for bearing against said riser and limiting said riser's lateral movement relative to said platform;

a pair of torsional rollers carried upon said frame the torsional rollers being positioned for bearing against said at least one fin to reduce any relative rotation between said riser and said platform;

a first plate mounted to said frame, said first plate being capable of translational movement relative to said frame; and wherein said torsional rollers are mounted to said first plate.

8. The device of claim 7 further comprising a second plate mounted to said first plate, said second plate being adjustably rotatable a limited amount relative to said frame; and wherein said torsional rollers are mounted to said second plate.

9. A device for centralizing a riser in a platform opening of an offshore platform, said riser having planar fins extending radially outward from its outer diameter for movement with the riser, comprising:

a frame having a frame opening and a first level and a second level for mounting to said platform with an axis of the frame opening over the platform opening;

a plurality of centralizing rollers adjustably mounted on said first level and radially extensible relative to said axis of said frame opening, for centralizing said riser;

a plurality of torsional rollers adjustably mounted in opposed pairs on said second level and extensible relative an opposed roller of each pair, for engaging said fins for limiting rotation of said riser relative to said platform.

10. The device of claim 9 wherein said torsional rollers are opposed to each other and adjustable toward and away from each other, to vary the spacing between said torsional rollers.

11. A device for centralizing a riser in a platform opening of an offshore platform, said riser having planar fins extending radially outward from its outer diameter for movement with the riser, comprising:

a frame having a frame opening and a first level and a second level for mounting to said platform with an axis of the frame opening over the platform opening;

a plurality of centralizing rollers adjustably mounted on said first level and radially extensible relative to said axis of said frame opening, for centralizing said riser;

a plurality of torsional rollers adjustably mounted in opposed pairs on said second level and extensible relative an opposed roller of each pair, for engaging said fins for limiting rotation of said riser relative to said platform;

a first plate mounted to said frame, said first plate being capable of translational movement relative to said frame; and wherein said torsional rollers are mounted to said first plate.

12. The device of claim 11 further comprising a second plate mounted to said first plate, said second plate being adjustably rotatable a limited amount relative to said frame; and wherein said torsional rollers are mounted to said second plate.

13. A device for connecting a subsea wellhead through a platform opening in an offshore platform, comprising:

a riser adapted to connect to said wellhead and having at least one fin extending outward from an outer diameter of said riser for movement with the riser;

a frame for mounting to said platform, said frame having a frame opening with an axis adapted to coincide with an axis of said platform opening;

a plurality of centralizing rollers carried on said frame and adjustable radially relative to said axis of said frame opening, for bearing against said riser and limiting said riser's lateral movement relative to said platform; and a pair of torsional rollers carried upon said frame, the torsional rollers being positioned for bearing against said at least one fin to reduce any relative rotation between said riser and said platform.

14. The device of claim 13 wherein said torsional rollers are opposed to each other and are adjustable toward and away from each other, to vary the spacing between said torsional rollers.

15. The device of claim 13 wherein said torsional rollers are angularly adjustable about said axis of said frame opening.

16. The device of claim 13 wherein said torsional rollers are laterally adjustable relative to said axis of said frame opening.

17. The device of claim 16 wherein each of said torsional rollers are rotatable about an axis generally parallel with a radial line of said axis of said frame opening.

18. A device for connecting a subsea wellhead through a platform opening in an offshore platform, comprising:

a riser adapted to connect to said wellhead and having at least one fin extending outward from an outer diameter of said riser for movement with the riser;

a frame for mounting to said platform, said frame having a frame opening with an axis adapted to coincide with an axis of said platform opening;

a plurality of centralizing rollers carried on said frame and adjustable radially relative to said axis of said frame opening, for bearing against said riser and limiting said riser's lateral movement relative to said platform;

a pair of torsional rollers carried upon said frame, the torsional rollers being positioned for bearing against said at least one fin to reduce any relative rotation between said riser and said platform;

a first plate mounted to said frame, said first plate being capable of translational movement relative to said frame; and wherein said torsional rollers are mounted to said first plate.

19. A device for connecting a subsea wellhead through a platform opening in an offshore platform, comprising:

a riser adapted to connect to said wellhead and having at least one fin extending outward from an outer diameter of said riser for movement with the riser;

a frame for mounting to said platform, said frame having a frame opening with an axis adapted to coincide with an axis of said platform opening;

a plurality of centralizing rollers carried on said frame and adjustable radially relative to said axis of said frame opening, for bearing against said riser and limiting said riser's lateral movement relative to said platform;

a pair of torsional rollers carried upon said frame, the torsional rollers being positioned for bearing against said at least one fin to reduce any relative rotation between said riser and said platform;

a second plate mounted to a first plate mounted to said frame and being capable of translational movement relative to said frame said second plate being adjustably rotatable a limited amount relative to said frame; and wherein said torsional rollers are mounted to said second plate.

20. A method for centralizing a riser in an opening of a floating offshore platform comprising:

providing a riser with a fin extending outward from an outer diameter of said riser for movement with the riser;

providing a centralizing device having a frame, a plurality of centralizing rollers adjustably mounted on said frame, and a plurality of torsional rollers mounted in opposed pairs on said frame;

mounting said centralizing device to said platform about said riser;

positioning said centralizing rollers to bear against said riser and generally centralize said riser in said opening; and positioning said torsional rollers on opposite sides of said fin and constraining relative torsional rotation of said riser relative to said platform.

* * * * *